US006464301B1

(12) United States Patent
Clos et al.

(10) Patent No.: US 6,464,301 B1
(45) Date of Patent: Oct. 15, 2002

(54) DEVICE AND METHOD FOR PROCESSING BRISTLE FILAMENTS OF BRUSHES

(75) Inventors: Thomas Clos, Montabaur; Andreas Lanvers, Bad Honnef, both of (DE)

(73) Assignee: M & C Schiffer GmbH (DE)

( * ) Notice: Subject to any disclaimer, the term of this patent is extended or adjusted under 35 U.S.C. 154(b) by 0 days.

(21) Appl. No.: 09/416,277

(22) Filed: Oct. 14, 1999

(30) Foreign Application Priority Data

Oct. 14, 1998 (DE) ..... 198 47 407

(51) Int. Cl.[7] ..... A46D 9/02
(52) U.S. Cl. ..... 300/17; 300/21
(58) Field of Search ..... 300/17, 21, 2

(56) References Cited

U.S. PATENT DOCUMENTS 1,563,367 A * 12/1925 Hultqvist ..... 300/21
2,272,800 A * 2/1942 Hall et al. ..... 300/17
2,365,396 A * 12/1944 Cunningham ..... 300/17 X
3,384,418 A * 5/1968 Guey et al. ..... 300/21
3,451,173 A * 6/1969 Hazelton ..... 300/17 X
5,020,551 A * 6/1991 Guerret ..... 300/21 X
5,683,145 A * 11/1997 Boucherie ..... 300/21 X

FOREIGN PATENT DOCUMENTS

DE 84741 * 1/1896 ..... 300/17
IT 458320 * 3/1949 ..... 300/17

* cited by examiner

*Primary Examiner*—Mark Spisich
(74) *Attorney, Agent, or Firm*—Anderson Kill & Olick, P.C.

(57) ABSTRACT

The present invention relates to a device and a method for processing bristle filaments, in particular toothbrushes, with an abrasive surface. In order to improve, in particular, the processing of contoured brushes, the abrasive surface is formed according to the present invention on at least one tooth flank of at least one tooth which is provided on a rotating circumferential surface and circulates in the rotational direction. The method according to the invention is characterized in that the bristle filaments are moved in a first direction substantially in parallel to at least one tooth flank comprising the abrasive surface, and in a second direction substantially at a right angle to the first direction, over the ridge of the at least one tooth.

17 Claims, 2 Drawing Sheets

DEVICE AND METHOD FOR PROCESSING BRISTLE FILAMENTS OF BRUSHES

The present invention relates to a device for processing bristle filaments of brushes, in particular tooth brushes, with an abrasive surface. Moreover, the present invention relates to a method of processing bristle filaments of brushes, in particular toothbrushes, in which an abrasive surface is moved relative to the operative ends of the bristle filaments.

The operative ends of the bristle filaments of a brush must be processed from time to time to remove ridges produced during manufacture of the bristle filaments. Moreover, in particular in the case of toothbrushes, the operative ends must be rounded off for protecting the mucous membrane. The aforementioned rounding operation poses problems in particular in cases where the bristles are profiled, i.e. not all of the operative ends of the bristle filaments are positioned in one plane. In particular in the case of toothbrushes, the bristles are provided with very different contours for achieving preferred cleaning effects, which makes the processing of the operative ends difficult and often produces unsatisfactory results.

DE-A-197 28 493 discloses an apparatus and a method for processing portions of a field of bristles of contoured brushes. The device comprises a template for deflecting and pressing away the longer bristle filaments in order to expose the shorter bristle filaments of the array of bristles at their operative ends, whereby they can be processed in a satisfactory manner. In this process the shorter bristle filaments project through openings provided on the template. EP 0 458 999 discloses a device comprising shield elements with inclined portions for deflecting selected bundles of bristles of a field of bristles so as to expose other bundles of bristles of the array of bristles and to process the same with the necessary intensity. The two above-described devices have the drawback that the shield elements and the template, respectively, must positioned in order to deflect the desired bristle filaments or bundle of bristles. This poses problems, in particular, in the case of an array of relatively densely positioned exactly bristles, as is for instance the case with toothbrushes.

An incorrect positioning is bound to have the effect that filaments which are arranged next to the bristle filaments to be deflected are also picked up by the template or the shield elements, whereby they are deprived of a processing operation. The aforementioned filaments will no longer be processed in a subsequent processing step in which the longer bristle filaments are rounded at their operative ends, so that the finished brush includes unprocessed bristle filaments and is thus defective. Moreover, the shield elements or the template obstruct a free wobble length of the bristle filaments to be processed, which length is needed for rounding the filaments in a satisfactory manner. Moreover, great effort is required for performing the above-described method with such a device.

WO 93/12691 discloses a method of producing a contoured brush in which only the bristle bundles whose operative ends are located in one plane are respectively connected to the brush body and rounded off with a conical grinder having a plain abrasive surface. First, the bristle filaments whose operative ends are positioned in the lowermost plane are connected to the brush body and rounded; then the next plane will be treated, etc. This method is very troublesome and, in the final analysis, can only be carried out in an economic way if the position of the operative ends of the bristle filaments is limited to a few planes and the planes are graded in discrete steps. Consequently, the prior method is not suited for producing subsequently rounded bristle filaments in an array of bristles having a continuous contour extension.

It is the object of the present invention to provide an apparatus and a method for efficiently processing the operative ends, in particular of contoured brushes, in an efficient manner.

To achieve the above object, the present invention provides for a device of the above-mentioned type in which the abrasive surface is formed on at least one tooth flank of at least one tooth provided on a rotating circumferential surface and circulating in a rotational direction.

The device according to the invention comprises at least one tooth, preferably a plurality of teeth, whose at least one tooth flank has formed thereon an abrasive surface. The teeth are provided on a rotating circumferential surface, e.g. on the circumferential surface of a drum or a rotating belt. The operative ends of the bristle filamerits are guided relative to the tooth flanks substantially in the longitudinal direction of the tooth flanks in a first direction, and in a second direction perpendicular to the first direction, over the ridge of the tooth or the teeth. The shape and configuration of the teeth allow different contours of the array of bristles can be accommodated. The array of bristles is guided in a direction transverse to the longitudinal extension of the tooth and over the tooth flank comprising the abrasive surface such that all of the operative ends of the bristle filaments can be processed in any plane of the contour. Practical tests have demonstrated that the device of the invention is far superior to conventional grinders that have a plain, abrasive and rotating surface which is substantially guided in wobbling fashion around the operative ends of the bristle filaments so as to round the same, i.e. in particular in the processing of a contoured array of bristles of a brush.

An automatic rounding of the operative ends of the bristle filaments, which are located in different planes, is in particular achieved in that said filaments travel over the tooth flank and sweep over the ridge of the tooth in a direction transverse to the longitudinal extension thereof. The aforementioned relative movement between the operative ends of the bristle filaments and the tooth comprising the abrasive surface can be achieved in that the rotating circumferential surface is axially adjustable and drivable, said movement being performed in axial direction preferably cyclically. In a preferred development, which yields a further constructional simplification, a plurality of teeth are however formed in the manner of a helix, thereby passing into one another on the circumferential surface. With such a development, the plurality of teeth that pass into one another in the form of a helix can be shaped on a cylinder like in the case of a conventional external thread. Alternatively, convolutions of a plurality of teeth extending in parallel with each other may be provided with a predetermined pitch on a circulating belt. Due to the arrangement of the teeth in the manner of a helix, the tooth flanks "travel" in an axial direction by virtue of the rotation of the circumferential surface so that the bristle filaments having different lengths are bound to contact the abrasive tooth flank with their operative ends while sweeping over the ridge, whereby they are rounded.

In an advantagous development of the device of the invention all teeth have an identical cross-sectional profile. The configuration of the saw-tooth profile is simplified by such a design. The profile can e.g. be obtained by "threading" on the circumferential surface of a cylinder.

To achieve the above object according to the method, the generic method is developed in the present invention by the measures that the bristle filaments are moved in a first direction substantially in parallel with at least one tooth flank comprising the abrasive surface, and in a second direction substantially extending at a right angle to the first direction, over the ridge of at least one tooth. It has been found to be of particular advantage when the relative movement between the bristle filaments and the abrasive surface in the first direction is set to a range between 5 and 30 m/s.

Further details, advantages and features of the present invention will become apparent from the attached drawings, in which.

Figure 1:
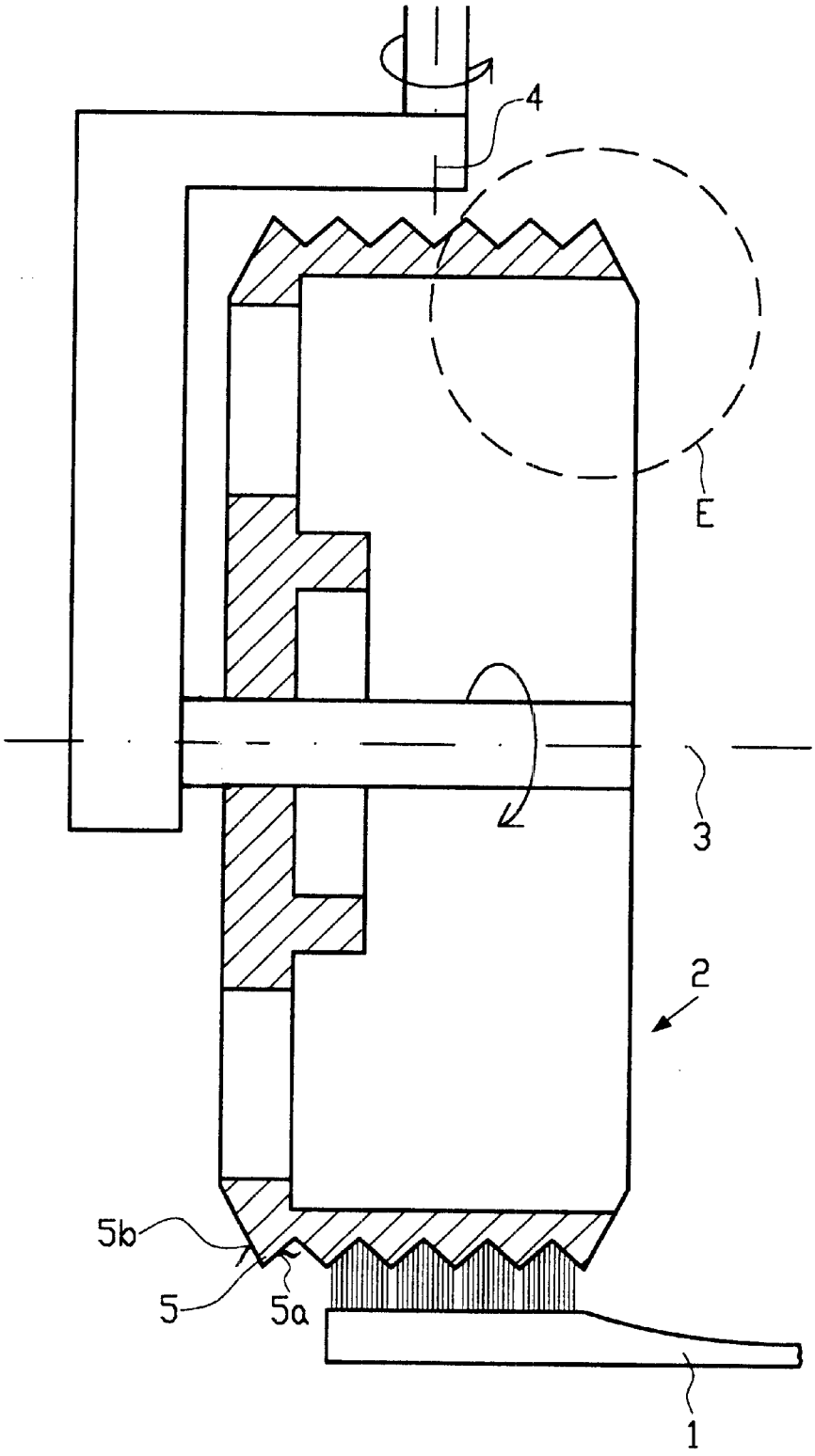
FIG.1 shows an essential part of an embodiment of a device for processing bristle filaments.

FIG. 1 is a schematic cross-sectional view showing an essential part of an embodiment of a device for processing bristle filaments of a brush 1. The device comprises a cylinder 2 shown in a cross-sectional view, which is rotatably supported and drivable around its central longitudinal axis 3. Moreover, the cylinder 2 is rotatably supported and drivable around a second axis 4 at a right angle relative to the central longitudinal axis 3.

The cylinder 2 is provided on its circumferential surface with a plurality of teeth 5 which in the manner of a thread are formed on the circumferential surface of the cylinder. Each of the tooth flanks 5*a*, 5*b* of the teeth 5 is provided with an abrasive surface which in the illustrated embodiment comprises diamonds having a surface roughness of 5 $\mu$m.

The device further comprises a holding device (not shown in greater detail) by which the toothbrush 1 is positioned such that the operative ends of the bristle filaments are pressed against the teeth 5 of the cylinder 2.

Figure 2:
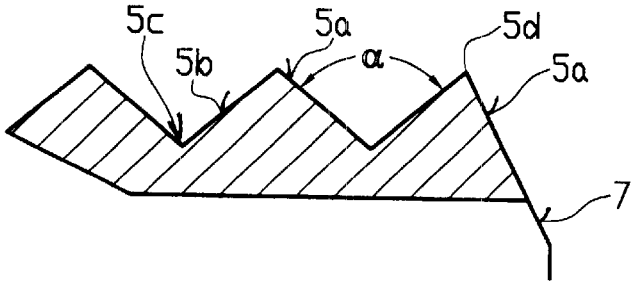
FIG. 2 shows an enlarged portion of the section labeled E of the embodiment shown in FIG. 1.

FIG. 2 shows a section E according to the illustration in FIG. 1 on an enlarged scale. The section shows details of the thread-like tooth profile formed on the circumferential surface of the cylinder 2. In the embodiment shown in FIGS. 1 and 2, all of the teeth have an identical cross-sectional profile. Adjacent teeth pass directly into one another via a pointed bottom 5*c*. The angle ax of the adjacent tooth flanks 5*a*, 5*b* within the pointed bottom 5*c* of the saw-tooth profile is 100° in the illustrated embodiment. The front face 7 of the cylinder 2 is inclined and the angle of inclination is relative to the central longitudinal axis of the cylinder 2 corresponding to the inclination of the outer tooth flank 5*a*.

Figure 3:
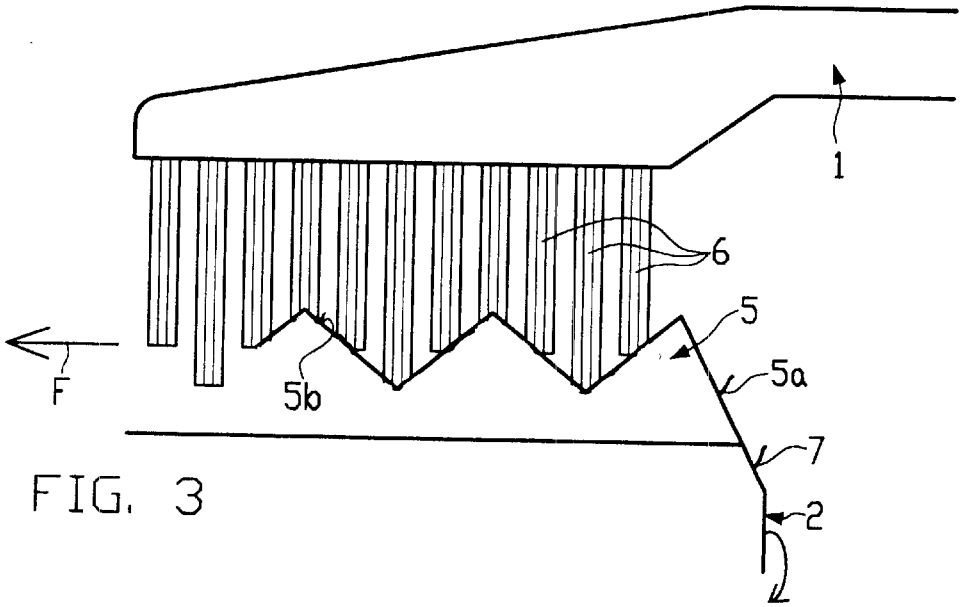
FIG. 3 shows a further embodiment of a cross-sectional profile with a part of a toothbrush to be processed.

FIG. 3 shows a further embodiment of a saw-tooth profile on the outer circumferential surface of the cylinder 2. The illustrated profile consists of identically formed teeth 5 which continuously surround the circumferential surface and pass into one another via a pointed bottom. The angle of adjacent tooth flanks 5*a*, 5*b* is matched to the profile of the toothbrush and is about 95° in the illustrated embodiment. As can be seen, the depth of thread should be chosen in dependence upon the profile of the toothbrush. In the position shown in FIG. 3, just the shortest bristle filaments 6 sweep over the ridge 5*d* of the teeth 5, whereas the longest bristle filaments 6 are positioned in the bottom 5*c* of the saw-tooth profile. When the depth of thread is chosen to be smaller than the depth of the profile, an unsatisfactory rounding of the shortest and/or longest filaments 6 may be observed.

As for the pitch of the thread, a pitch of 2–8 mm, preferably 3–6 mm, has turned out to be suitable. The pitch of the thread is to have the effect that the bristle filaments of a toothbrush, which is stationarily held during processing, is forced to sweep along one flank 5*a* over the ridge and back over the other flank 5*b* of the teeth 5.

As an alternative to the configuration of the teeth 5 in the manner of a thread with teeth 5 helically passing into one another, said teeth may also be arranged in annular fashion on the circumferential surface with a serpentine course. In the case of an annular straight extension of the teeth 5, the sweeping action over the ridges can also be accomplished by taking other measures, for instance by means of a drive by which the cylinder 2 is reciprocated axially in a cyclic fashion. To ensure that bristle filaments of different lengths are pressed against the abrasive surfaces formed on the tooth flanks 5*a*, 5*b*, the profiles of the teeth may also change, for instance, in the circumferential direction.

When, starting from the position shown in FIG. 3, the cylinder 2 is rotated, the teeth 5 will "travel" in a direction F. Thus, the operative ends of the bristle filaments 6 are pressed against the abrasive flanks 5*a*, 5*b* of the teeth 5. Ideally, the operative ends will first be processed at the one side of the flank 5*b* until the respective bristle filaments have swept over the ridge 5*d*. Then the other side is processed by the flank 5*a* while the operative ends of the bristle filaments "travel" relative to the cylinder surface towards the bottom 5*c*. To achieve an ideally semispherical rounding of the operative ends of the bristle filaments, which is as uniform as possible, the cylinder 2 is additionally rotated about the axis 4 in the illustrated embodiment.

Figure 4:
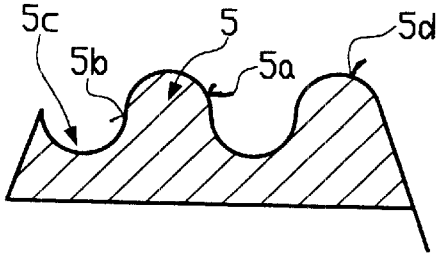
FIG. 4 shows a further embodiment of a cross-sectional profile.

The geometrical design of the cross-sectional shape of the profiles is substantially influenced by the contour of the brush. For instance, it may be preferred to round off the peak and the bottom of the teeth 5, as shown in FIG. 4. In the embodiment shown in FIG. 4, the ridge 5*d* is formed by a convex surface with a radius of 1.5 mm, whereas the bottom 5*c* is formed by a concave surface with the same radius of curvature. The aforementioned a configuration is especially preferred in cases where the predominant part of the operative ends of the array of bristles is arranged in two main planes. The operative ends which are arranged in the lower main plane are here processed on the convex ridge of the teeth whereas the longer operative ends are processed in the concave bottom.

Figure 5:
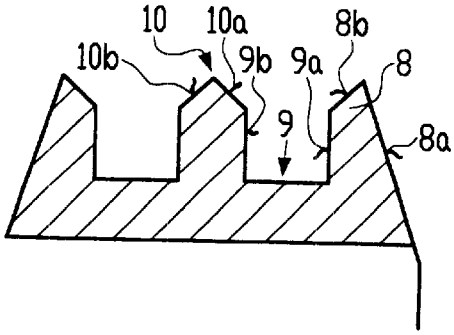
FIG. 5 shows a fourth embodiment of a cross-sectional profile.

FIG. 5 shows a further embodiment of a cross-sectional profile. In this embodiment the teeth are provided with a different geometry. Next to an outer tooth 8, there is formed an annular groove 9 having side walls 9*a*, 9*b* of an identical height. An identical configuration is provided at the opposite side of a central tooth 10. The central tooth 10 has the same outer diameter as the outer teeth 8. Both tooth flanks 10*a*, 10*b* of the central tooth 10 have an identical inclination and are oriented relative to each other at an angle of about 90°. An abrasive surface is formed on all surfaces 8*a*, 8*b*, 10*a*, 10*b*. By contrast, the surfaces of the groove 9 have no abrasive surface.

The aforementioned a configuration of the saw-tooth profile is particularly preferred for brushes which have an array of bristles with a pronounced plateau of the operative ends of the longest bristle filaments and comprise only a few bristle filaments in the area of a second plane. The geometry shown in FIG. 5 avoids an excessive abrasion of the longer bristle filaments. The filaments can dip into the groove, remaining there without any abrasive processing. An abrasive processing will only take place if the bristle filaments of the brushes to be rounded sweep over the flank surfaces 10*a*, 10*b*.

As becomes apparent from the illustrated embodiments, the present invention is not restricted to the design of a uniform thread having specific geometries of the flanks: the height of the teeth, the geometrical design of the bottom 5*c*, the pitch of the flanks 5*a*, 5*b*, the geometrical design of the ridge, or the like, may be formed in any desired way.

What is claimed is:

1. A device for processing bristle filaments of brushes comprising:

a body moveable about a central axis thereof, a plurality of teeth provided on a circumferential surface of said body, each tooth of said plurality of teeth is defined by a pair of flanks angled toward an apex thereof, said teeth having an abrasive surface formed on at least one flank thereof and wherein the plurality of teeth are helically arranged on said circumferential surface so as to move in a helical pattern when the body is moved about the central axis and the body further being rotably supported and driven about a second axis perpendicular to the central axis.

2. A device according to claim 1, wherein all of the plurality of teeth have identical cross-sectional profiles.

3. A device according to claim 1, wherein at least one tooth comprises a rounded ridge.

4. A device according to claim 1, wherein adjacent tooth flanks enclose an angle a of 60–100° thereinbetween.

5. A device according to claim 1, wherein at least one tooth flank has a convex surface and a concave surface.

6. A device according to claim 1, wherein the teeth are formed on an outer circumferential surface of a rotating cylinder.

7. device according to claim 6, wherein a front face of the cylinder extending towards an outer tooth is inclined.

8. A device according to claim 1, wherein a groove is formed between adjacent teeth.

9. A device according to claim 1, wherein at least one center tooth projects over at least one front tooth.

10. A device according to claim 1, wherein the abrasive surface has a surface roughness of 2–15 pm.

11. A device according to claim 1, wherein the abrasive surface is drivable relative to the bristle filaments at a speed of 5–30 m/s.

12. A device according to claim 1, wherein at least one tooth flank has a convex surface.

13. A device according to claim 1, wherein at least one tooth flank has a concave surface.

14. A device according to claim 1, wherein the teeth are formed on an outer circumferential surface of a circulating belt.

15. A device according to claims 14, wherein a front face of the belt extending towards an outer tooth is inclined.

16. A method of processing bristle filaments of brushes, comprising the steps of:

providing a device comprising a body movable about a central axis thereof, a plurality of teeth provided on a circumferential surface of said body, each tooth of said plurality of teeth is defined by a pair of flanks angled toward an apex thereof, said teeth having an abrasive surface formed on at least one flank thereof and wherein the plurality of teeth are helically arranged on said circumferential surface so as to move in a helical pattern when the body is moved about the central axis and the body further being rotatably supported and driven about a second axis substantially perpendicular to the central axis; and bringing the bristles of a brush into contact with the teeth and relatively moving the bristles relative to the teeth so as to process the free ends thereof.

17. A method according to claim 16, wherein the relative speed between the bristle filaments and the abrasive surface is between 5 and 30 m/s.

* * * * *